US006945398B2

(12) United States Patent
Shumake et al.

(10) Patent No.: US 6,945,398 B2
(45) Date of Patent: Sep. 20, 2005

(54) CARRIER WITH INTEGRAL ACCESSORIES FOR PORTABLE DISPLAY DEVICE

(75) Inventors: Patsy Viars Shumake, Statesville, NC (US); Thomas Edmond Wiberg, Statesville, NC (US)

(73) Assignee: Hunt Holdings, Inc., Wilmington, DE (US)

( * ) Notice: Subject to any disclaimer, the term of this patent is extended or adjusted under 35 U.S.C. 154(b) by 73 days.

(21) Appl. No.: 10/405,005

(22) Filed: Mar. 31, 2003

(65) Prior Publication Data

US 2003/0205489 A1 Nov. 6, 2003

Related U.S. Application Data

(60) Provisional application No. 60/377,514, filed on May 3, 2002.

(51) Int. Cl.[7] ..... B65D 85/28

(52) U.S. Cl. ..... 206/371; 206/224; 206/575

(58) Field of Search ..... 206/371, 224, 206/575, 449, 555, 451, 459.5, 494, 784, 542, 457, 579; 229/904, 87.05

(56) References Cited

U.S. PATENT DOCUMENTS 2,808,191 A * 10/1957 Cramer ..... 206/562
3,346,104 A * 10/1967 Marsh ..... 206/472
3,640,380 A * 2/1972 Huffman ..... 206/549
4,225,039 A * 9/1980 Skaggs ..... 206/193
4,645,077 A * 2/1987 McLaughlin et al. ..... 206/449
4,717,023 A * 1/1988 Oprean ..... 206/459.5
4,794,712 A 1/1989 Wood ..... 40/605
5,293,705 A 3/1994 Wood ..... 40/124.1
5,911,522 A 6/1999 Wood ..... 40/124.09
6,155,413 A * 12/2000 Bilanchone ..... 206/229

* cited by examiner

*Primary Examiner*—Jacob K. Ackun
*Assistant Examiner*—J Williams
(74) *Attorney, Agent, or Firm*—McNees Wallace & Nurick LLC; Kurt L. Ehresman; Jonathan P. Miller

(57) ABSTRACT

A carrier for a portable display device that facilitates transportation thereof. The carrier includes a plurality of connected panels configured to permit the carrier to wrap around the portable display device and releasably latch to support the portable display device for carrying via an integral handle member of the carrier. The carrier may subsequently be unlatched to permit removal of the portable display device for use for display purposes, and relatched for subsequent transportation. The carrier may include integrally attached accessories die cut along with the carrier from a unitary sheet of corrugated paperboard for tear away removal therefrom. Such accessories may include a header, stencil cards, or alignment tools, such as a protractor, T-square or triangle. Removable adhesive labels may be provided on the carrier. The carrier may be scored for folding for compact storage, etc. A display kit including a portable display device and carrier is also provided.

17 Claims, 7 Drawing Sheets

FIG.4
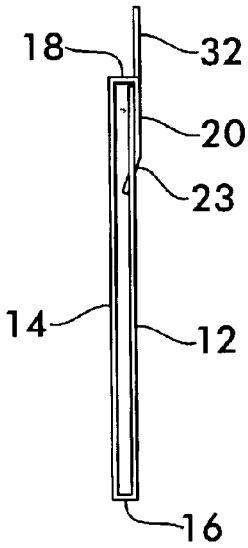
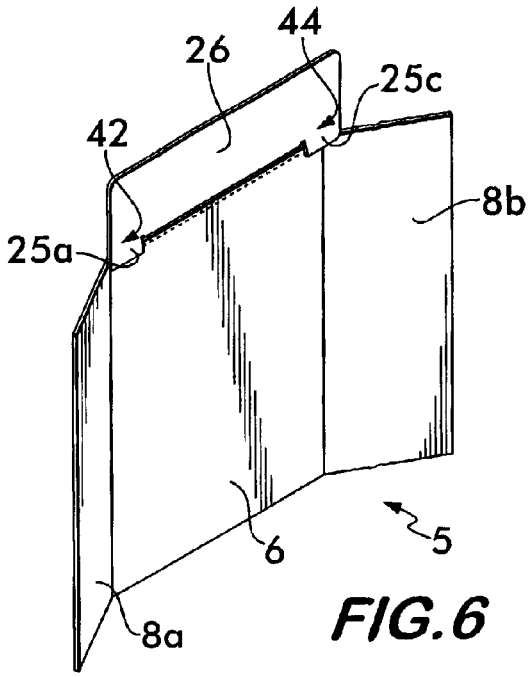
FIG.6
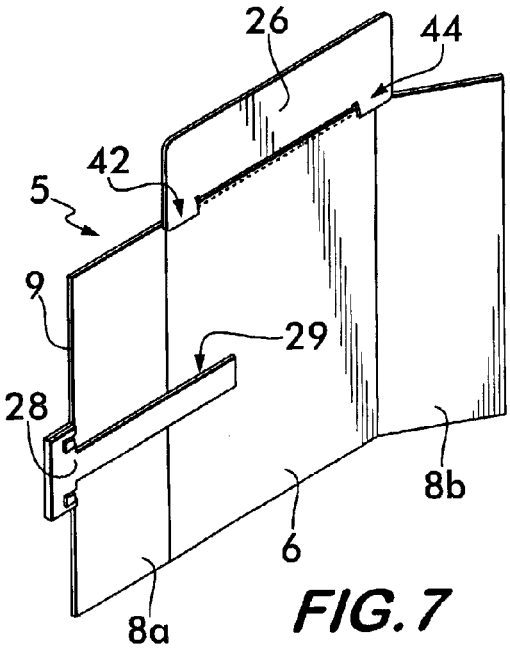
FIG.7
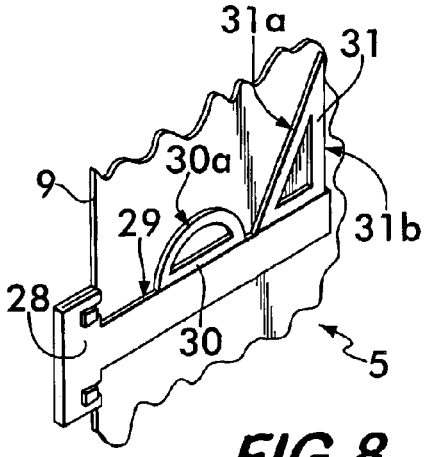
FIG.8

CARRIER WITH INTEGRAL ACCESSORIES FOR PORTABLE DISPLAY DEVICE

CROSS-REFERENCE TO RELATED APPLICATION

This application claims the benefit of U.S. Provisional Patent Application No. 60/377,514, filed May 3, 2002.

FIELD OF THE INVENTION

The present invention relates generally to portable display devices for displaying corporate, educational, promotional and/or artistic material. In particular, the present invention relates to a carrier for such a portable display device.

DESCRIPTION OF RELATED ART

Portable display devices are well known in the art. For example, such portable display devices are often used in corporate, educational and institutional settings, where corporate educational, promotional, artistic and/or other materials (collectively, "display materials") are mounted to the portable display devices for viewing as part of a display or by an audience during a presentation. Exemplary portable display devices are disclosed in U.S. Pat. No. 4,794,712, to Wood, U.S. Pat. No. 5,293,705 to Wood and U.S. Pat. No. 5,911,522 to Wood, the entire disclosures of these patents being hereby incorporated herein by reference. Such portable display devices typically include a single or tri-fold panel including a center panel 6 and a pair of side panels 8*a*, 8*b* hingedly attached to opposite sides of the center panel 6, as shown in FIG. 1. While such display devices have become popular, various improvements are believed necessary to use such devices more advantageously. For example, such portable display devices are awkward and cumbersome to transport, even when folded or collapsed.

As another matter, display materials are typically mounted to the portable display device, by glue, tape, tacks, staples, etc. Traditionally, it has been difficult to properly orient the display materials relative to the portable display device, e.g. precisely vertically, precisely horizontally, or at a desired angle with respect to a horizontal axis. Accordingly, the arrangement of mounted display materials may appear sloppy.

In the case of a tri-fold or other foldable portable display devices, it is often difficult to maintain the folding display device in an open position. Additionally, space for mounting display materials on the portable display device is limited and additional space is sometimes desired.

SUMMARY OF THE INVENTION

In one aspect, the present invention provides a carrier for a portable display device that facilitates transportation thereof. The carrier includes a plurality of connected panels configured to permit the carrier to wrap around the portable display device and releasably latch in a closed position, to support the portable display device, preferably in a folded position. Preferably, the carrier is die cut from a unitary sheet of corrugated paperboard. The carrier includes a handle to facilitate transportation of the portable display device. Accordingly, the portable display device may be folded, if applicable, wrapped with the latched carrier device to support the portable display device and protect it from damage, and then carried by use of the carrier's handle. The carrier device may subsequently be unlatched to permit removal of the portable display device. If desired, the carrier may be reused to transport the portable display device.

In another aspect of the invention, the carrier is specially configured, e.g. with perforations in the panel(s) at suitable locations, with punch-out alignment accessories for facilitating desired placement of display materials on a portable display device. For example, the alignment accessories may include a T-square, protractor, 30°-60°-90° triangle, 45°-45°-90° triangle, etc. Such alignment accessories may be used as generally known in the drafting and/or graphic arts to align display materials as desired with respect to the portable display board. The perforations allow corresponding portions of the sheet member to be broken away from a remainder of the carrier for use as the alignment accessories. Similarly, the carrier may be specially configured to provide a punch-out stencil card for use as a stencil is drawing letters, numbers, symbols, shapes, etc Optionally, the carrier can be further configured with additional perforations in the sheet member at suitable locations for providing a header accessory capable of attaching to a folding portable display device to retain it in an open position and to provide additional space for mounting of display materials.

Removable adhesive labels, stickers, etc. may be provided on the carrier, e.g. for use in created a display on a display board.

In a certain embodiment, the carrier is specially configured for folding for compact storage, transportation, or retail display.

BRIEF DESCRIPTION OF THE DRAWINGS

FIG. 4 is an end view of the folded carrier of FIG. 3;

FIG. 6 is a perspective view of the portable display device of FIG. 1, shown with the header accessory mounted thereon to maintain the device in an open position;

FIG. 7 is a perspective view of the portable display device of FIG. 1 and header accessory of FIG. 6, shown with the T-square accessory in an operational position;

FIG. 8 is a perspective view of the portable display device of FIG. 1 and T-square accessory of FIG. 7, shown with the triangle and protractor accessories in an operational position;

DETAILED DESCRIPTION

Figure 1:
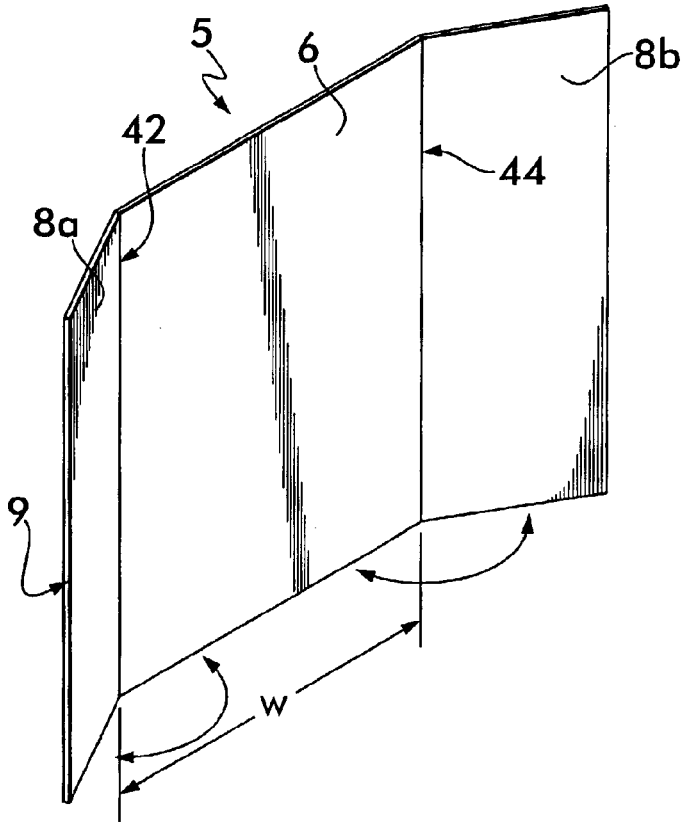
FIG.1 (Prior Art)
FIG. 1 is a perspective view of an exemplary trifold portable display device as known in the prior art.

The present invention provides a carrier having an integral handle that can be fastened around a portable display device, such as the folded trifold display device of FIG. 1, to allow the display device to be easily carried. An exemplary carrier 10 is shown wrapped around an exemplary display device 5 in FIG. 3.

Figure 2:
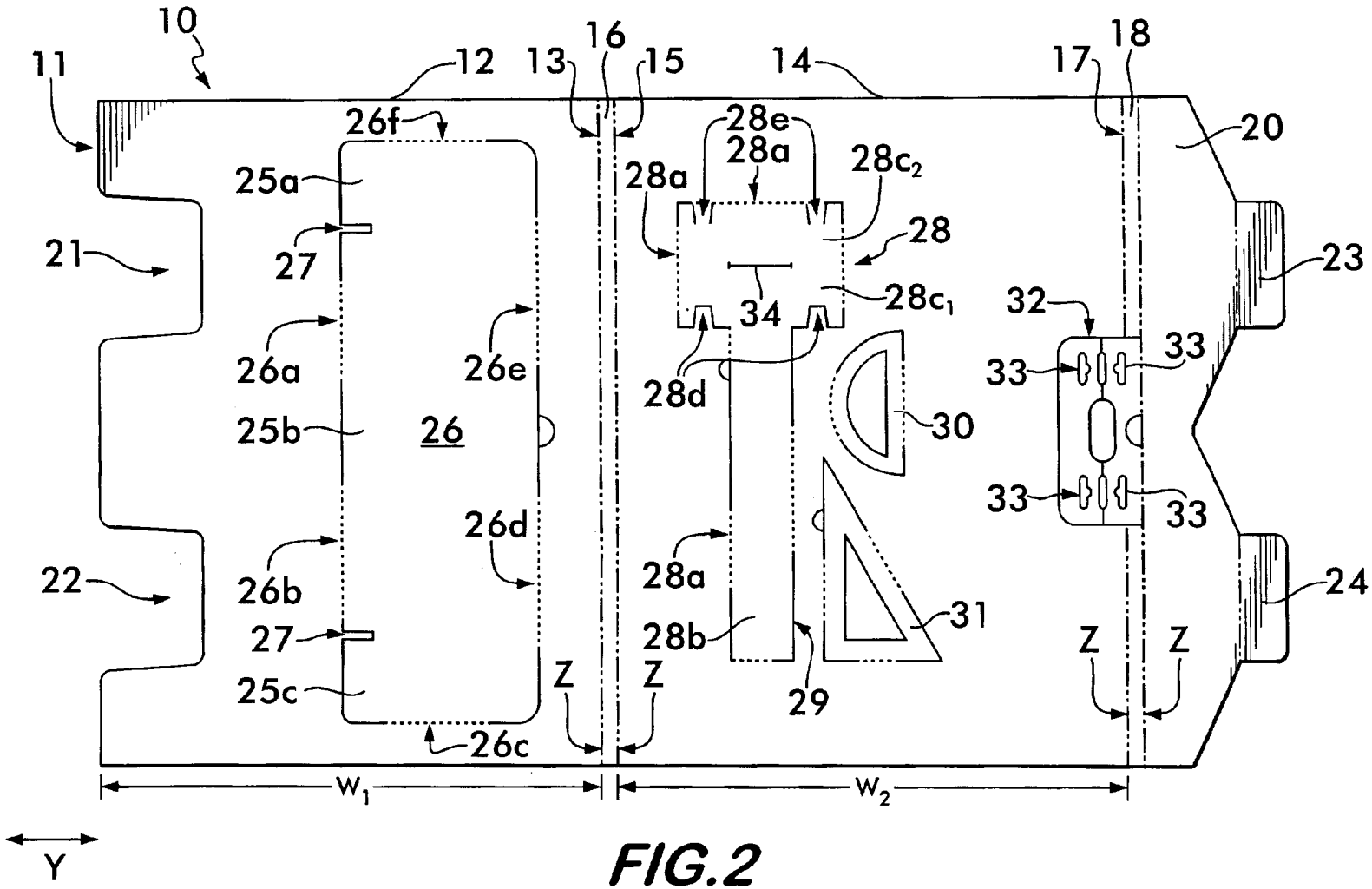
FIG. 2 is a plan view of an exemplary carrier in accordance with the present invention, shown in an open position.

As best shown in FIG. 2, the carrier 10 includes a first panel 12 for forming a front of the carrier (front panel 12), a second panel 14 for forming a back of the carrier (back panel 14), a first hinge panel 16 connecting the front and back panels 12, 14 for forming a bottom of the carrier, a closure flap panel 20 for forming a top of the carrier and for latching the carrier in a substantially closed loop configuration, and a second hinge panel 18 joining the back panel 14 to the closure flap 20, as discussed in detail below. Preferably, the entire carrier device 10 is constructed of a unitary die cut sheet of corrugated material such as paper, cardboard or plastic, or foamboard, chipboard, paperboard or any other solid or foamed board or sheet that is capable of being die cut and/or scored, as the sheet is preferably scored adjacent the hinge panels 16, 18 to facilitate folding in the desired locations along fold line Z. The preferred direction of corrugation is shown at Y in FIGS. 1, 9 and 10.

As shown in FIG. 2, the front panel 12 has a first end 11, a second end 13 opposite the first end 11, and a width $W_1$ dimensioned to accommodate a portable display device, such as the width W of a tri-fold portable display device 5 in a folded position (see FIG. 1 showing a trifold opened). The front panel 12 has openings 21, 22 adjacent the first end 11 for receiving latch tabs 23, 24 of the closure flap 20, as discussed below.

The back panel 14 has a first end 15 hingedly attached to the front panel 12 through the hinge panel 16, and a second end 17 opposite the first end 15, and a width $W_2$ dimensioned to accommodate the portable display device 5 in a folded position (see FIG. 1), and therefore may be similar in width to front panel 12.

In the illustrated embodiment, the first and second hinge panels 16, 18 are hingedly attached to the front and back panels 12, 14. In this manner, the first hinge panel 16 is hingedly attached to the second end 13 of the front panel 12 to be pivotable about a fold line Z, and further hingedly attached to a first end 15 of the back panel 14 to be pivotable about another fold line Z. Additionally, the second hinge panel 18 is hingedly attached to the second end 17 of the back panel 14 to be pivotable about a fold line Z, and further hingedly attached to the closure flap panel 20 to be pivotable about another fold line Z.

In an alternative embodiment (not shown), the front and back panels 12, 14 are connected to one another without a hinge panel therebetween. In another embodiment, the front and back panels 12, 13 include the first and second hinge panels 16, 18, respectively.

Figure 3:
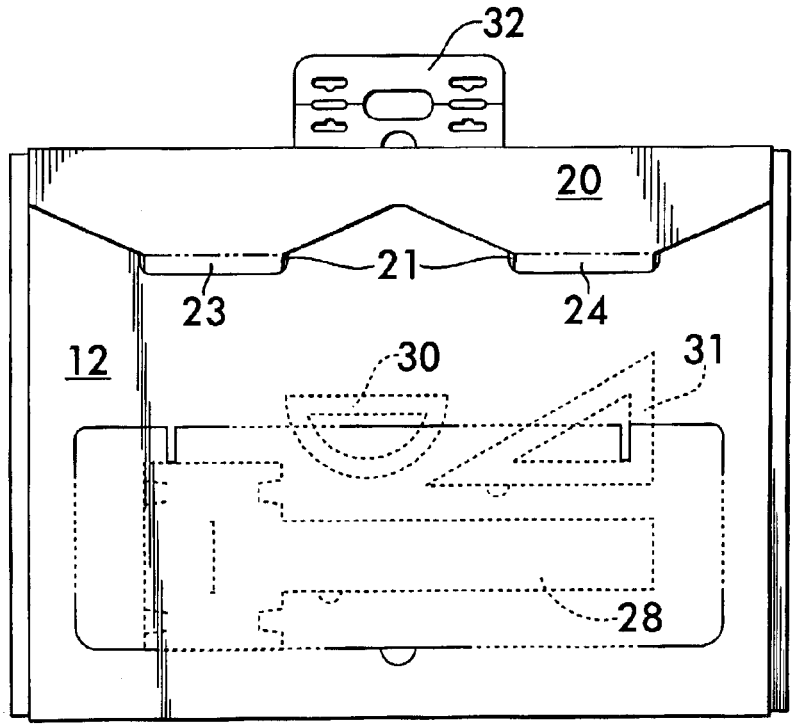
FIG. 3 is a front view of a display kit including the carrier of FIG. 2, shown in a folded position as wrapped around the folded portable display device of FIG. 1.

The closure flap 20 is hingedly attached to the back panel 14 opposite the first panel 12, e.g. by the second hinge panel 18. The closure flap 20 is configured with latch tabs 23, 24 to interfit with the openings 21, 22 of the front panel 12 to releasably latch the carrier 10 in a substantially closed loop configuration for carrying the portable display device therein. FIG. 3 shows the carrier 10 positioned in the substantially closed loop configuration, wrapped around the portable display device 5 of FIG. 1, with the latch tabs 23, 24 of the closure flap 20 shown interfitted with the openings 21, 22 to releasably latch the carrier 10 in the substantially closed loop configuration. In alternative embodiments of the carrier 10, the latch tabs 23, 24 and front panel 12 may include matable hook and loop fasteners for closing the carrier, or the front panel 12 and closure flap 20 may be provided with a button and string closure, similar to those of interoffice mail envelopes. Any suitable closure may be used to allow the carrier to be latched in a substantial closed loop configuration. In this manner, the carrier 10 may be carried by a hand graspable handle member 32 while the portable display device remains securely retained within the carrier 10, e.g. for ease of transportation.

The handle member 32 is integrally attached to the carrier 10 for supporting it. In the illustrated embodiment of FIGS. 2-8, the handle member 32 is die cut into the back panel 14 and second hinge panel 18. FIG. 3 shows a front view of a display kit 60 including the carrier 10 of FIG. 2, shown in a folded position as wrapped around the folded portable display device 5 of FIG. 1, with the handle member 32 pivoted into an operable position for grasping to support the carrier 10 and portable display device 5. The handle 32 or another portion of the carrier 10 is preferably provided with peg holes 33 for receiving a peg for retail display purposes. Although a die cut handle is preferred, other handle configurations, such as a separate, attached handle, are also contemplated.

Referring now to FIGS. 2, 6 and 7, the carrier 10 may include an integrally attached header accessory 26 which can be used to provide additional display space and/or to brace a foldable display board in an open (unfolded) position. Although the header 26 may be attached to any panel, preferably, the header 26 is integrally attached to the front panel 12, as shown in FIG. 2. The header 26 is die cut into the front panel 12 to be at least partially separated from the carrier 10 by a perforated portion for tear-away removal therefrom. The header 26 is thereby fixedly retained in the front panel 12 until it is released by tearing the perforated portions 26*a*, 26*b*, 26*c*, 26*d*, 26*e*, 26*f*. It should be noted that the perforations can be positioned in any suitable pattern or position to provide any suitable shape or configuration and to retain the header 26 for tear-away removal from the carrier 10. Preferably, the header 26 includes an elongated body 25 having a pair of spaced notches 27 extending inwardly of the body 25 and transversely thereto, as shown in FIG. 2.

The carrier 10 may also include integrally attached tool accessories. Although the tool accessories may be attached to any panel, preferably, the tool accessories are integrally attached to the back panel 14, as shown in FIG. 2. Each of the tool accessories is at least partially separated from the carrier 10 by perforations so that the accessory may be releasably removed from the carrier 10 by tear-away removal therefrom. This may be achieved by providing an accessory and carrier that are die cut from a unitary sheet, such as a unitary sheet of corrugated paperboard.

For example, one tool accessory may be a T-square 28 attached by perforated portions 28*a*. The T-square 28 has an elongated member 28*b* and a transversely extending head 28*c* having first and second sections $28c_1$, $28c_2$, section $28c_2$ being foldable to about a fold line 34 (preferably a score). A pair of spaced notches 28*d* extend inwardly of the head section $28c_1$ and $28c_2$ substantially parallel to the elongated member 28*b*. A pair of spaced tabs 28*e* extend opposite the notches 28*d*. When removed from the carrier 10, the second section $28c_2$of the head of T-square 28 is folded about fold line 34 to create a thick head for butting against the display board. Tabs 28*e* are displaceable out of plane to interlock with notches 28*d*, thereby locking sections $28c_1$ and $28c_2$ adjacent one another to create the thick head (see FIGS. 7 and 8). In this manner, an edge 29 of the T-square 28 forms a reference surface at 90° to the edge of the display device 5 for positioning of display materials and/or drawing of reference lines on the portable display device.

Other possible tool accessories include a protractor 30 having a semi-circular outer edge, and a three-sided triangle 31, both of which are similarly integrally attached to the carrier 10 by perforations. The protractor, T-square, triangle or other tools may be provided with printed, painted or other reference markings to designate units of linear or angular measurement, as desired, as is well-known in the art. It should be noted that any other desired tool accessories, such as a ruler, L-square, alphabetical, numerical, and/or geometric stencils, etc. may be integrally attached to the panel, as desired, and that the T-square, protractor or triangle may have alternative shapes, as desired.

The carrier 10 described above can be used to carry a portable display device 5 by folding the carrier 10 around the portable display device 5 by folding the front, back and/or hinge panels 12, 14, 16, 18 to form a substantially closed loop, as shown in FIGS. 3 and 4. In this manner, the carrier 10 substantially encloses the portable display device 5 positioned therein, as shown in FIG. 3. For example, the folded (closed) display device 5 can be placed on top of the back panel 14, the front panel 12 can then be folded on top of the display device 5 so as to sandwich the display device 5 between the front and back panels 12, 14 and also to form hinge panel 16. Next the closure flap 20 is folded and latch tabs 23, 24 are interfitted or tucked into openings 21 and 22 to latch the closure flap 20 to the front panel 12. This fixes the carrier 10 in a closed (folded) position, as shown in FIGS. 3 and 4. In this manner, the carrier maintains a foldable portable display device 5 in a closed (folded) position and facilitates transportation of the same. The handle 32 may be punched out (displaced out of the plane of the carrier panel(s)) for carrying the carrier 10 and portable display device 5, as shown in FIG. 3. The carrier 10 and portable display device 5 may then be carried about by manually grasping the handle 32.

Figure 5:
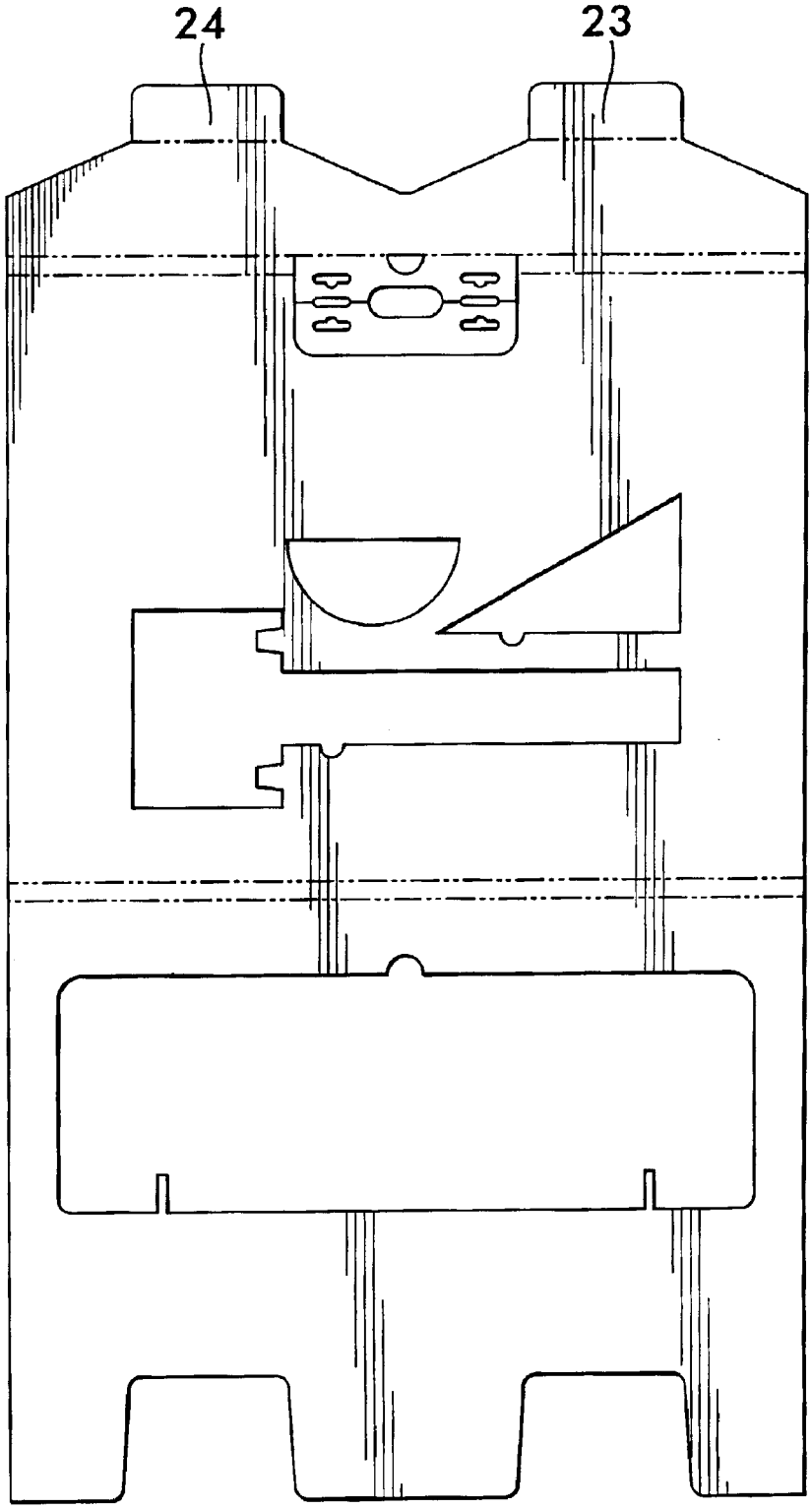
FIG. 5 is a plan view of the carrier of FIG. 2 shown with the accessories removed.

The carrier 10 may be used to set up a display including a display board 5 using the tool accessories 28, 30, 31 and header accessory 26. The tool accessories 28, 30, 31 may removed from the panels 12, 14 by tearing along the perforated portions. The header 26 may be similarly removed. This produces a carrier 10 with a punched out header and tools, as shown in FIG. 5. It should be noted that the carrier 10 may still be folded and used for transporting a portable display device, similarly to as it is shown in FIG. 3, even after the header and tool accessories are removed from the panels 12, 14.

With reference to FIG. 6, the header 26 may be positioned atop a top edge of the portable display device. In this manner, the header 26 provides additional space where additional display materials, such as a project title, may be mounted. The header 26 is provided with notches 27 as best shown in FIG. 2. Tabs 25*a*, 25*c* defined by the notches 27 may be positioned on one side of the portable display device 5 (the side interior to the fold of the hinge) while a tab 25*b* defined between the notches 27 may be positioned on an opposite side of the portable display device. In this manner, the header 26 is securely positioned on the portable display device 5, as shown in FIGS. 6 and 7.

For the foldable portable display device 5 of FIG. 1, the header may be positioned transversely to the hinged portions 42, 44 where the panels 6, 8*a*, 8*b* of the portable display device 5 fold, as shown in FIGS. 6 and 7. The tabs 25*a*, 25*c* and notches 27 are positioned on the header 26 so that the tabs 25*a*, 25*c* overlie the hinges 22, 24 of the portable display device 5 to retain the portable display device 5 in an open position, as shown in FIGS. 6 and 7.

As shown in FIG. 7, the T-square 28 may be folded about the dividing fold 34 (see FIG. 2) to create a thick head for butting against an edge 9 of the portable display device 5. The edge 29 of the T-square provides a substantially horizontal reference surface (when the edge 9 of the portable display device is vertical) that assists in orienting any display materials (not shown) relative to the portable display device 5. For example, a bottom edge of a rectangular sheet of paper may be aligned with a top edge 29 of the T-square 28 to ensure that the paper is vertically and horizontally aligned relative to the portable display device 5. It should be noted that a panel of the folding portable display device may be folded closed and the T-square 28 may still be used to reach positions further inward of the portable display device's edge 9.

As shown in FIG. 8, a protractor 30 or triangle 31 may similarly be positioned on the top edge 29 of the T-square 28 to provide additional reference edges, e.g. 30*a*, 31*a*, 31*b* for aligning display materials relative to the portable display device 5. Similarly, the protractor 30 may be used to provide markings and the triangle or another straight edge may be used to draw lines to serve as layout markings for positioning materials at desired locations on the portable display device.

Figure 9:
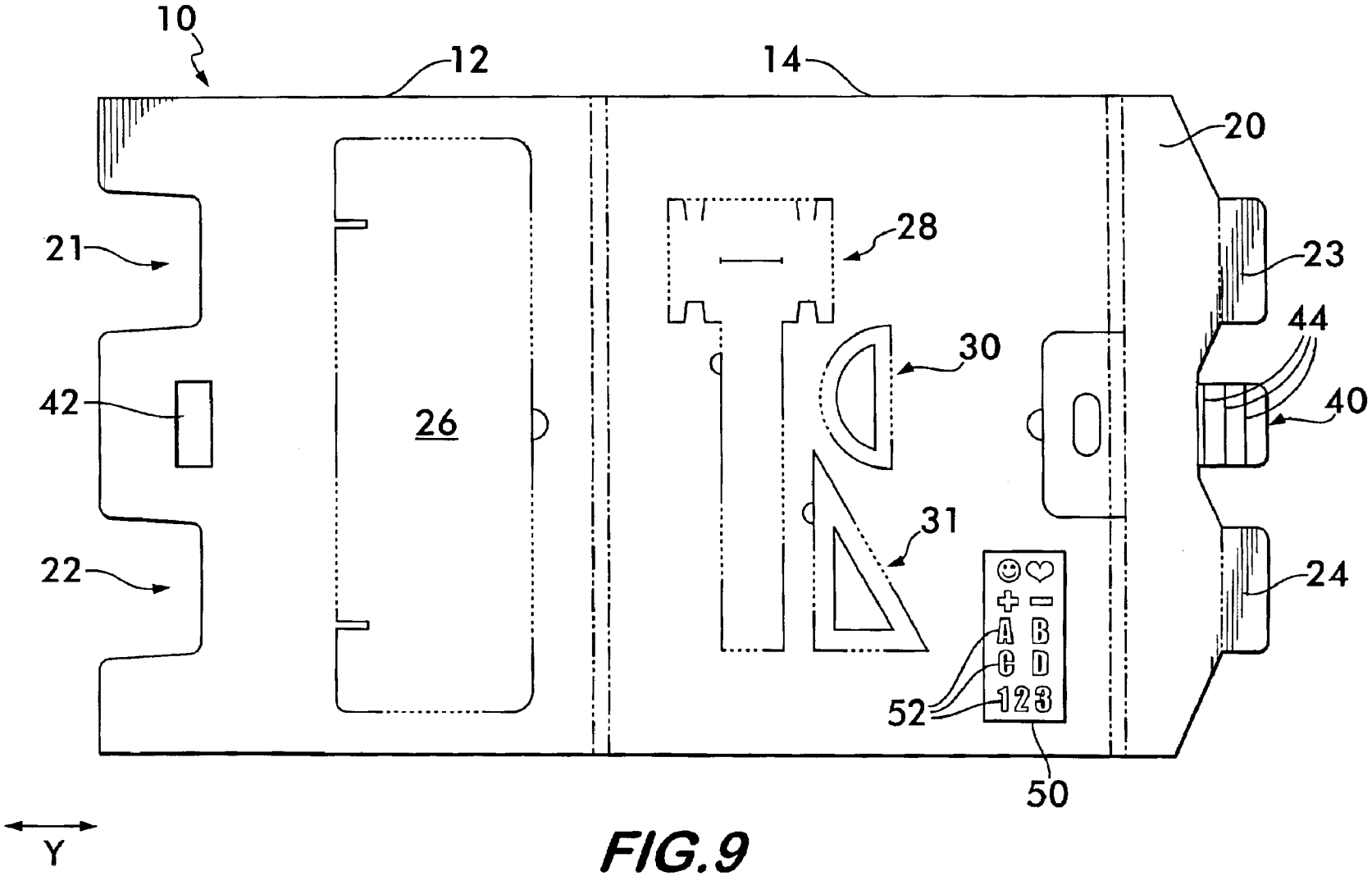
FIG. 9 is a plan view of an exemplary carrier in accordance with an alternative embodiment of the present invention, shown in an open position.

FIG. 9 shows an alternative embodiment of the present invention in which the carrier 10 includes a locking tab 40 and a corresponding locking notch 42. The locking tab 40 is positioned on the closure flap panel 20 between the latch tabs 23, 24 and the locking notch (opening) 42 is positioned on the front panel 12 between the openings 21, 22 for receiving the latch tabs 23, 24. The locking tab 40 may be scored to create creases 44 that render the locking tab 40 more flexible to facilitate interfitting of the locking tab 40 into the locking notch 42. The locking tab 40 enhances the ability of the folded carrier 10 to stay in the closed position due to the high friction forces between the locking tab 40 and carrier 10/locking notch 42, which is particularly important after any header 26, alignment accessories 28, 30, 31 or other punch-out accessories are removed from the carrier panels 12, 14, which tends to decrease overall rigidity of the panels and carrier. The carrier 10 is folded and unfolded for use much like the carrier 10 of FIGS. 1–8, with the addition of weaving/interfitting of the locking tab 40 into the locking notch 42 to latch the carrier 10 in a substantially closed loop configuration, much like interfitting of the latch tabs 23, 24 into the openings 21, 22.

The embodiment of FIG. 9 further illustrates that a carrier 10 may be provided with a release sheet 50 mounted to the carrier, e.g. the back panel 14 as shown in FIG. 9. For example, the release sheet 50 may be adhered to the carrier. On the release sheet 50 are provided conventional adhesive-backed labels, stickers, etc. (collectively, "stickers") 52 that may be removed from the release sheet and adhered to a display board to form part of a display, if desired. Such release sheets and adhesive-backed stickers are well known in the art, and the individual stickers may provide any desired shape, image, etc. as will be appreciated by those skilled in the art.

Figure 10:
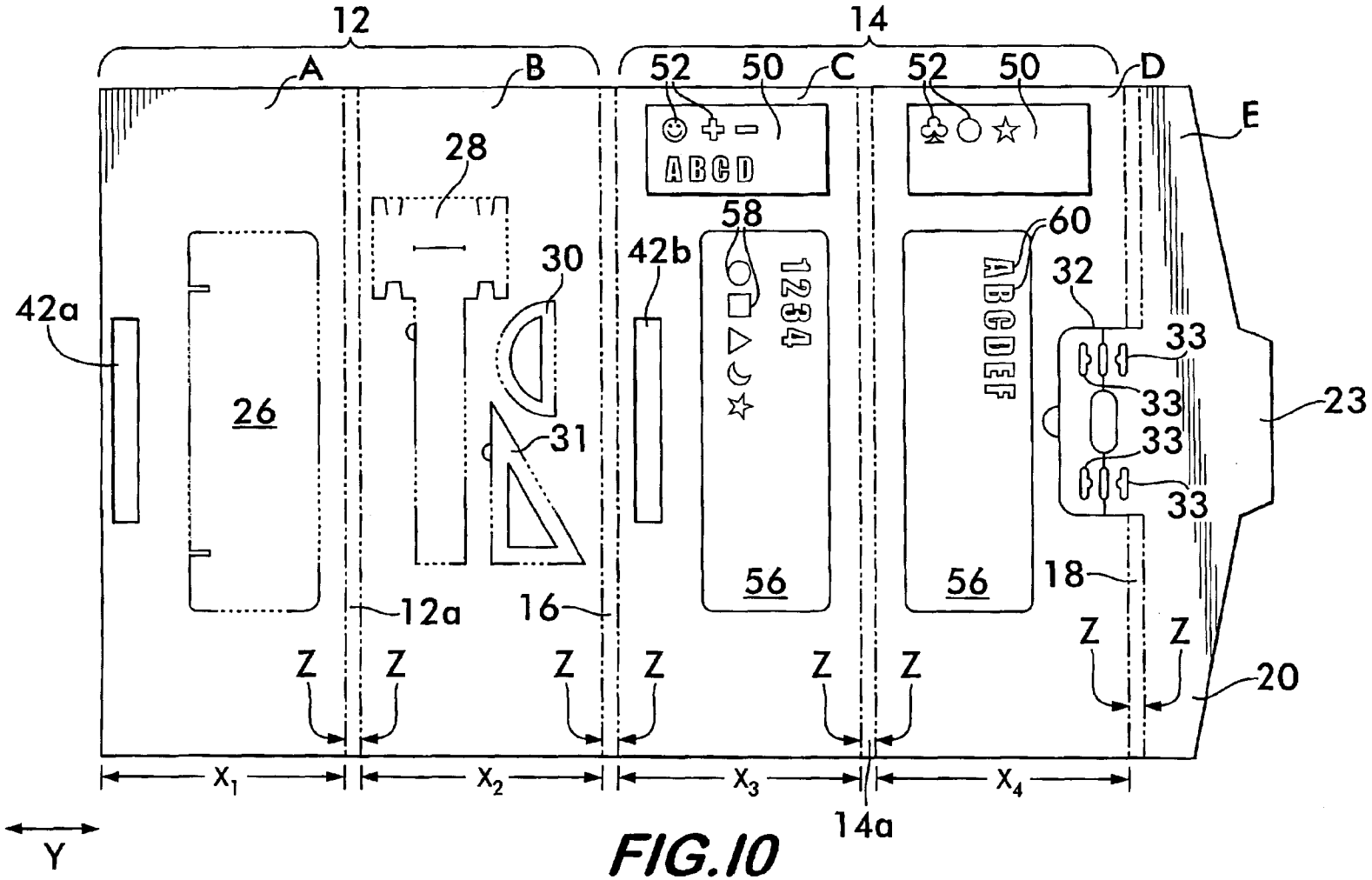
FIG. 10 is a plan view of an exemplary carrier in accordance with yet another alternative embodiment of the present invention, shown in an open position.
Figure 11:
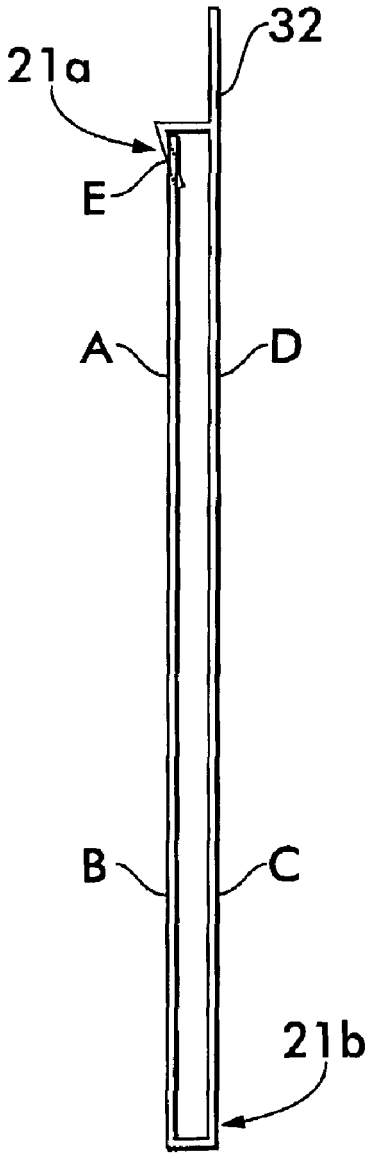
FIG. 11 is an end view of the folded carrier of FIG. 10, shown folded in a position for carrying a display device.
Figure 12:
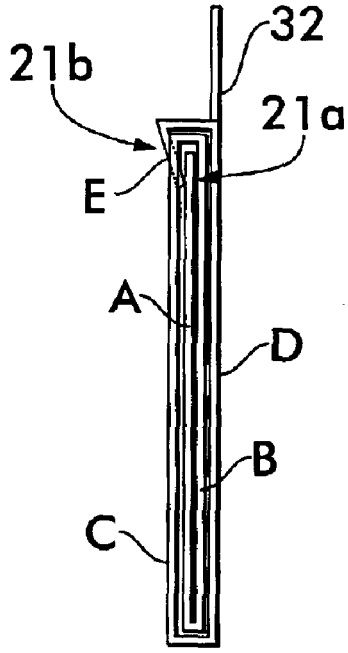
FIG. 12 is an end view of the carrier of FIG. 10, shown folded in a position for compact display and/or storage.

FIGS. 10–12 show an exemplary carrier 10 in accordance with yet another alternative embodiment of the present invention. This embodiment is similar to the embodiments of FIGS. 1–8 and 9 in that the carrier 10 includes front and back panels 12, 14, a closure flap panel 20 separated by hinge panels 16, 18 such that the carrier 10 can be folded around a display board and latched for carrying purposes, as shown in FIG. 11, which is similar to FIG. 4. In the exemplary embodiment of FIG. 10, an alternative closure flap panel 20 is shown that includes a single, central latch tab 23 that can be interfitted/woven into a corresponding locking notch 42*a*, similar to the configuration shown in FIG. 9.

However, as best shown in FIG. 10, in this embodiment the front and back panels 12, 14 are scored to form intermediate hinge panels 12*a*, 14*a*. Additionally, the back panel 14 is provided with a locking notch 42*b* for receiving the latch tab 23, just as the front panel 12 is provided with a similar locking notch 42*a*. Optionally, the intermediate hinge panels 12*a*, 14*a* are provided with scores and/or cuts (ZZ, FIG. 10) to facilitate folding, e.g. extending in a direction of the fold lines Z. The scores forming fold lines Z are positioned to define individual panels A, B, C, D having respective widths $X_1$, $X_2$, $X_3$, $X_4$, that permit folding of the carrier 10 in a spiral configuration, as best shown in FIG. 12. For example, panels having equal widths, or nearly equal widths with $X_4$ being larger than $X_3$, which is larger than $X_2$, which is larger than $X_1$, have been found suitable. In this manner, the carrier 10 can be latched in closed loop configuration with the latch tab 23 in the locking notch 42*a* to carry a display board, or can alternatively be latched in a compact state by folding panel A over B, panels A and B over C, and panels A, B and C over D, and then inserting the latch tab 23 into the locking notch 42*b* of panel C. In other words, the carrier may be releasably latched in a substantially closed loop configuration with the first panel 12 (including panels A and B and intermediate hinge panel 12*a*) sandwiched between portions of said second panel 14 (namely panels C and D) when the first and second panels 12, 14 are folded along the hinge panels 16, 18 and the intermediate hinge panels 12*a*, 14*a* in a spiral configuration, as shown in FIG. 12. In this compact state, the carrier 10 is not sufficiently sized to carry a display board, but rather is compact for storage, display at a retail store, e.g. hanging from peg hooks inserted through peg holes 33, or for transportation when not carrying a display board.

The exemplary carrier of FIG. 10 illustrates that a carrier in accordance with the present invention may include stencil card accessories 56 that are separated from remaining portions of the carrier 10 by perforated portions, much like the header 26, as discussed above. In this manner, the stencil cards 56 may be punched out from the carrier 10 by tearing along the perforated portions. The stencil cards 56 may be precut to have openings 58 in the shape of desired letters, numbers, symbols, designs, etc., or may be provided with die cut perforated portions that can be torn to punch out/remove portions 60 of the carrier 10/stencil cards 56 to create openings 58 having such shapes, so that the stencil cards 56 may be used in a conventional fashion as stencils for creating such shapes, e.g. on a display board.

Optionally, the carrier 10 of FIG. 10 is provided with header 26 and alignment accessories 28, 30, 31 similar to those shown in FIGS. 1–9. Although these accessories may be positioned at any suitable location of the carrier, they are shown for illustrative purposes in panels A and B of front panel 12. Additionally, the carrier 10 is provided with release sheets 50 and stickers 52, as discussed above with respect to FIG. 9, which are shown for illustrative purposes as provided in panels C and D of back panel 14.

Having thus described particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. A carrier for a portable display device that is capable of being folded around said display device, said carrier comprising:

a first panel for forming a front of the carrier, said first panel having a first end and a second end opposite said first end, said first panel having an opening;

a second panel for forming a back of the carrier, said second panel having a first end hingedly attached to said first panel, and a second end opposite said first end, said display device being sandwiched between said first and second panels when said carrier is folded around said display device;

a closure flap panel hingedly attached to said second panel opposite said first panel, said closure flap panel being configured to interfit with said opening of said first panel to releasably latch said carrier in a substantially closed loop configuration for carrying the portable display device therein;

a hand graspable handle member integrally attached to said carrier; and an accessory comprising at least one item selected from the group consisting of a header portion, a T-square portion, a triangle portion, a protractor portion and a stencil card, wherein said carrier and said accessory are die cut from a unitary sheet of corrugated paperboard, said accessory being die cut into said carrier for tear-away removal therefrom and wherein said accessory is at least partially separated from said carrier by a perforated portion being separable from said carrier, wherein the header portion has an elongated body having a pair of spaced notches extending inwardly of said body and transversely thereto, the T-square portion has an elongated member and a transversely extending head defining a pair of spaced notches extending inwardly of said head and substantially parallel to said elongated member, the triangle portion has three sides, the protractor portion has a semi-circular outer edge, and the stencil card has an elongated body and a plurality of die cut portions to define shapes for use as stencils.

2. The carrier of claim 1, wherein said first panel comprises a first hinge panel forming a bottom of the carrier, said first panel being attached to said second panel through said first hinge panel.

3. The carrier of claim 1, further comprising a second hinge panel forming a top of the carrier, said second panel being attached to said closure flap panel through said second hinge panel.

4. The carrier of claim 1, wherein said handle member is formed as an integral part of said carrier.

5. The carrier of claim 4, wherein said carrier and said handle member are die cut from a unitary sheet of corrugated paperboard, said handle member being die cut into said carrier or pivotable displacement therefrom to provide a handle for supporting said carrier.

6. The carrier of claim 1, further comprising a release sheet mounted to said carrier, said release sheet supporting a plurality of removable adhesive-backed stickers.

7. The carrier of claim 1, said first and second panels comprising intermediate hinge panels, said second panel having a second opening configured to interfit with said closure flap panel to releasably latch said carrier in a substantially closed loop configuration with said first panel sandwiched between portions of said second panel when said first and second panels are folded along said hinge panels and said intermediate hinge panels in a spiral configuration.

8. A carrier for a portable display device that is capable of being folded around said display device, said carrier comprising:

a first panel for forming a front of the carrier, said first panel having a first end and a second end opposite said first end, said first panel having an opening;

a first hinge panel hingedly attached to said second end for forming a bottom of the carrier;

a second panel for forming a back of the carrier, said second panel having a first end hingedly attached to said first hinge panel, and a second end opposite said first end;

a second hinge panel hingedly attached to said second end of said second panel for forming a top of the carrier;

a closure flap panel hingedly attached to said second hinge panel opposite said second panel, said closure flap panel being configured to interfit with said opening to releasably latch said carrier in a substantially closed loop configuration for carrying the portable display device therein; and a hand graspable handle member integrally attached to said carrier;

wherein said first and second panels comprise intermediate hinge panels, said second panel having a second opening configured to interfit with said closure flap panel to releasably latch said carrier in a substantially closed loop configuration with said first panel sandwiched between portions of said second panel when said first and second panels are folded along said hinge panels and said intermediate hinge panels in a spiral configuration.

9. The carrier of claim 8, wherein said handle member is formed as an integral part of said carrier.

10. The carrier of claim 9, said carrier and said handle member being die cut from a unitary sheet of corrugated paperboard, said handle member being die cut into said carrier for pivotable displacement therefrom to provide a handle for supporting said carrier.

11. The carrier of claim 9, further comprising an accessory, said carrier and said accessory being die cut from a unitary sheet of corrugated paperboard, said accessory being die cut into said carrier for tear-away removal therefrom.

12. A display kit comprising:

a portable display device for use to display material during a presentation; and a carrier for said portable display device that is capable of being folded around said display device, said carrier comprising:

a first panel for forming a front of the carrier, said first panel having a first end a second end opposite said first end, said first panel having an opening adjacent said first end;

a second panel for forming a back of the carrier, said second panel having a first end hingedly attached to said first panel, and a second end opposite said first end;

a closure flap panel hingedly attached to said second panel opposite said first panel, said closure flap panel being configured to interfit with said opening to releasably latch said carrier in a substantially closed loop configuration for carrying the portable display device therein; and a hand graspable handle member integrally attached to said carrier;

said carrier being foldable to position said first panel adjacent one side of said portable display device and said second panel adjacent an opposite side of said portable display device to surround said carrier in a substantially closed loop configuration and wherein said portable display device comprises a tri-fold panel.

13. The display kit of claim 12, wherein said closure flap panel is positioned in interfitting relationship with said opening of said first panel to releasably latch said carrier in a substantially closed loop configuration for carrying the portable display device therein.

14. The display kit of claim 12, wherein said handle member is formed as an integral part of said carrier.

15. The display kit of claim 12, said carrier further comprising an accessory, said carrier and said accessory being die cut from a unitary sheet of corrugated paperboard, said accessory being die cut into said carrier for tear-away removal therefrom.

16. The display kit of claim 12, further comprising a release sheet mounted to said carrier, said release sheet supporting a plurality of removable adhesive-backed stickers.

17. The display kit of claim 12, said first and second panels comprising intermediate hinge panels, said second panel having a second opening configured to interfit with said closure flap panel to releasably latch said carrier in a substantially closed loop configuration with said first panel sandwiched between portions of said second panel when said first and second panels are folded along said hinge panels and said intermediate hinge panels in a spiral configuration.

* * * * *